United States Patent [19]

Sherman et al.

[11] Patent Number: 4,637,056

[45] Date of Patent: Jan. 13, 1987

[54] OPTICAL CORRELATOR USING ELECTRONIC IMAGE PREPROCESSING

[75] Inventors: Rand C. Sherman, Upper Arlington; Daniel R. Grieser, Columbus, both of Ohio

[73] Assignee: Battelle Development Corporation, Columbus, Ohio

[21] Appl. No.: 541,407

[22] Filed: Oct. 13, 1983

[51] Int. Cl.[4] ..... G06H 9/76

[52] U.S. Cl. ..... 382/31; 350/162.13; 364/822; 382/42

[58] Field of Search ..... 382/31, 42; 350/162.12, 350/162.13, 162.14; 250/550; 364/822, 724; 333/165, 166

[56] References Cited

U.S. PATENT DOCUMENTS

| | | | |
|---|---|---|---|
| 3,435,244 | 3/1969 | Burckhardt et al. | 250/219 |
| 4,006,351 | 2/1977 | Constant | 364/724 |
| 4,073,010 | 2/1978 | Casasent et al. | 382/42 |
| 4,082,429 | 4/1978 | Ward, III et al. | 350/162 SF |
| 4,082,431 | 4/1978 | Ward, III | 350/162 SF |
| 4,187,000 | 2/1980 | Constant | 364/822 |
| 4,462,046 | 7/1984 | Spight | 382/42 |
| 4,490,849 | 12/1984 | Grumet et al. | 382/31 |
| 4,514,059 | 4/1985 | McDonnell | 350/162.12 |

OTHER PUBLICATIONS

Siverston et al., "Spectral Feature Classification and Spatial Pattern Recognitions", *Proc. Soc. Photo-Optical Instrum. Eng.*, vol. 201, Opt. Pattern Rocog., 1979, pp. 17–26.

Leighty et al., "New Approach to Automated Optical/-Digital Pattern Recognition", *Proc. Soc. Photo-Optical Instrum. Eng.*, vol. 85, Opt. Processing Sys., 1979, pp. 120–129.

Fujii et al., "Rotational Filtering for Randomly Oriented Pattern Rec.", *Optics Communications*, vol. 36, No. 4, Feb. 15, 1981, pp. 255–257.

A. Vander Lugt, "Signal Detection by Complex Spatial Filtering," *IEEE Trans. Inform. Theory*, vol. IT-10, pp. 139–145, Apr. 1964.

J. D. Armitage and A. W. Lohmann, "Character Recognition by Incoherent Spatial Filtering" *Appl. Opt.*, vol. 4, pp. 461–467, 1965.

A. Vander Lugt, "Coherent Optical Processing," *Proc. IEEE*, vol. 62, pp. 1300–1319, Oct. 1974.

W. T. Maloney, "Lensless Holographic Recognition of Spatially Incoherent Patterns in Real Time" *Appl. Opt.*, vol. 10, pp. 2127–2131, 1971.

*Primary Examiner*—Leo H. Boudreau
*Assistant Examiner*—Joseph Mancuso
*Attorney, Agent, or Firm*—Seidel, Gonda, Goldhammer & Abbott

[57] ABSTRACT

An optical processing system uses spatial filtering to recognize two-dimensional functions and images. Images of real objects are captured with a television camera. The electronic signals representing the two-dimensional function or image are electronically preprocessed, such as by edge enhancement techniques or by applying a curvature function, and displayed on a narrow-band-phosphor cathode ray tube or television monitor. The monitor image is used directly as the input to an incoherent holographic correlator. Alternatively, the monitor image is used to modulate a source of coherent radiation such as a laser via a spatial light modulator to generate a modulated optical signal which is the input to a coherent holographic correlator. Analyzer circuitry with an optical detector at the correlation plane analyzes the shape of the correlation function to determine the intensity and position of its peak. The input to the CRT or monitor may also be in the form of non-optically generated electronic signals representative of a two-dimensional function for display in graphic form by the CRT or monitor.

16 Claims, 8 Drawing Figures

100
102
104
106
PREPROCESSOR
108
110
112
114
116
120
122
124
126
128
IMAGE PLANE
130
CORRELATION IMAGE
132
REAL IMAGE
136
138
DIFFERENTIATION
140
PROCESS ELECTRONICS
142
IMAGE SIZE ADJUST
OUTPUT
x
y
z

100'
106
PREPROCESSOR
104
102
116'
CORRELATION IMAGE 130'
$f_2$
$f_2$
$f_1$
$f_1$
124
126'
122
120
156
152
150
154
114
108
110
y
x
z
IMAGE SIZE ADJUST
142
OUTPUT
PROCESS ELECTRONICS
140
DIFFERENTIATION
138
REAL IMAGE 132'
IMAGE PLANE 128
136

IN
OUT
+5V
+12V
-12V
200
202
204
206
208
210
212
214
216
218
220
222
224
226
228
230
234
236
238
240
242
244
246
248
250
252
254
256
258
260
262
264
266
268
270
272
274
276
278
280
282
284
286
290
292
294
296

OPTICAL CORRELATOR USING ELECTRONIC IMAGE PREPROCESSING

BACKGROUND OF THE INVENTION

The present invention relates generally to pattern recognition using either spatially coherent or spatially incoherent radiation. More particularly, the present invention relates to optical correlation utilizing electronic preprocessing of the pattern or image before it is input to the optical correlator.

The desirability of a relatively simple, reliable apparatus for detecting and recognizing specific patterns has long been recognized. For example, a device which would automatically determine whether patterns such as airplane images are included on aerial photographs would reduce the time and error of visual examination of photographs. As another example, a device which would automatically recognize and distinguish between different physical objects such as tools would be of great value in industrial robots.

One type of pattern recognition system, described in "Signal Detection By Complex Spatial Filtering," by A. Vander Lugt, IEEE Transactions On Information Theory, Vol. IT-10, p. 139, April, 1964, includes a hologram recording of a Fourier transformed image of the pattern to be recognized. Generally speaking, a hologram is a recording of both amplitute and phase of a light wave front. A Fourier transformed hologram is a recording of the amplitude and phase of the Fourier transform of the light waves reflected from an object.

The Vander Lugt apparatus requires the use of spatially coherent light, such as laser light. In order to process images in the Vander Lugt system, graphic information must be displayed on a spatial light modulator and illuminated by the laser light in order to provide an optical input signal which is spatially coherent.

The use of a hologram for pattern detection and recognition by correlation filtering using spatially incoherent light was suggested in 1965 by Armitage and Lohmann in Appl. Opts. 4, 461 (1965). The processing of images or two dimensional functions with spatially incoherent radiation has several distinct advantages over systems utilizing coherent radiation. Since coherent radiation is unnecessary, the need for a laser is eliminated. In addition, there is no need for a spatial light modulator to modulate the laser radiation. Spatial light modulators can be extremely expensive. Moreover, the positioning of the matched spatial filter in the filter plane is not critical in an incoherent system as it is in a system which uses coherent radiation.

The system described by Armitage and Lohmann included an incoherent light source, lenses and a matched spatial filter in the form of a Fourier transformed hologram. The Armitage and Lohmann system is insensitive to the location of the hologram along any axis and as long as the hologram is not rotated in the x-y plane. This is an improvement over the coherent system, wherein the relative position of the hologram is much more critical. In the incoherent system, pattern detection is achieved by the use of a matched filter initially formed from an image of the pattern to be detected. Like the coherent system, the incoherent system is "shift invariant", that is, because the matched filter is a Fourier transformed hologram, the system is able to recognize a pattern independently of its location with respect to the x-y axes.

Since the early work of Vander Lugt and Armitage and Lohmann, both coherent and incoherent spatial filtering have been widely studied. Heretofore, however, incoherent optical correlation has been less sensitive than coherent optical correlation. That is, an incoherent system's ability to discriminate among several objects is inferior to that of a coherent system.

The present invention is applicable to both coherent and incoherent optical correlation and recognizes that electronic preprocessing of the image which forms the input to the optical correlator may be performed to improve the correlation of the pattern to be recognized over an unpreprocessed image. By electronically preprocessing the image, an optical correlator may correlate to specific characteristics and features of the image which could not be done from the unpreprocessed image. When electronic preprocessing of an image is used in conjunction with incoherent optical correlation, performance and accuracy of the correlation is improved. Heretofore, no one has recognized the advantages to be obtained by this approach.

SUMMARY OF THE INVENTION

The present invention is directed to an apparatus for optical correlation of a two-dimensional function. The apparatus comprises means for generating a first electronic signal representative of said function and means for electronically performing at least one mathematical operation on said first electronic signal to derive a second electronic signal, and means for converting the second electronic signal into an optical signal. The apparatus further comprises means for generating an optical correlation function having first and second lens means arranged so that their respective optical axes are substantially in alignment. The input to the first lens means is the optical signal. A matched optical filter means is located between the first and second lens. Optical detecting means are located on the side of the second lens means opposite the filter means and at the image plane of the second lens means for detecting the optical correlation function generated by the first and second lens means and the filter means. The optical detecting means generates a third electronic signal representative of the optical correlation function. The third electronic signal is electronically analyzed in electronic analyzer means to determine the amplitude and position of the peak of the optical correlation function.

The present invention also includes a method for performing optical correlation of a two-dimensional function, and comprises the steps of generating a first electronic signal representative of the function, electronically performing at least one mathematical operation on the first electronic signal to derive a second electronic signal, converting the second electronic signal into an optical signal having an associated mathematical image function, generating an optical correlation function by combining said mathematical image function with a filter transfer function, electronically detecting the optical correlation function and generating a third electronic signal representative of the optical correlation function, and electronically analyzing the third electronic signal to determine the amplitude and position of the peak of the optical correlation function.

The apparatus and method of the present invention may be employed with either coherent or incoherent radiation.

For the purpose of illustrating the invention, there are shown in the drawings forms which are presently preferred; it being understood, however, that this invention is not limited to the precise arrangements and instrumentalities shown.

DETAILED DESCRIPTION OF THE INVENTION

Figure 1:
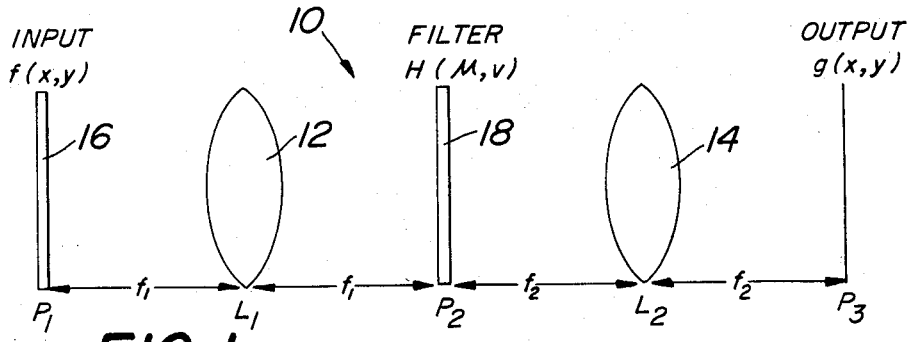
FIG. 1 PRIOR ART
FIG. 1 illustrates a simplified coherent spatial filtering system known in the prior art.

FIG. 1 illustrates a simplified coherent spatial filtering system 10. The coherent system 10 comprises a first lens 12 and a second lens 14 which are separated by a distance equal to the sum of the focal lengths $f_1$ and $f_2$ of the individual lenses 12 and 14. In the coherent system 10, a photo transparency 16 of a pattern to be recognized is located at the input plane P1. The transparency 16 is illuminated from the left by coherent light from a source of coherent light such as a laser (not shown). The first lens 12 is a converging lens which focuses the coherent light projected through the transparency 16. A matched spatial filter 18, in the form of a Fourier transformed hologram of the pattern to be recognized, is located behind the first lens 12 by a distance equal to the focal length $f_1$ of lens 12 so that a Fourier transformed image of the photo transparency 16 is projected onto the hologram 18. (The term hologram as used herein refers to holographic matched spatial filters as used in coherent and incoherent filtering systems.) If the photo transparency 16 at the input plane P1 contains the pattern to be recognized, and if the pattern is of a predetermined size and angular orientation, a composite output image will be projected from the hologram 18 through the second lens 14 onto an output plane P3. The hologram 18 and output plane P3 are each separated from the second lens 14 by a distance equal to the lens focal length $f_2$. Input plane P1, output plane P3 and plane P2 of hologram 18 are mutually parallel. The composite image at the output plane P3 will consist of three fairly intense spots of light. The spot of light which represents the correlation of the pattern to be recognized and the pattern of the hologram 18 is sensed by optical detecting means (not shown). From the intensity of the correlation spot and its location in respect to the x-y axes, one can deduce a match between the patterns on the input transparency 16 and the hologram 18 and can deduce the location of the pattern on the transparency 16.

The output amplitude distribution of the correlation function at the output plane P3 in response to coherent light is described by the equation $$g(x,y)=h(x,y)*f(x,y) \tag{1}$$

where the asterisk denotes the convolution operation, f(x,y) is the input amplitude distribution function and h(x,y) is the inverse Fourier transform of the filter transfer function H(u,v). H(u,v) is by definition the coherent transfer function of hologram 18. The description of this system 10 may also be given by the equation $$G(u,v)=H(u,v)\times F(u,v) \tag{2}$$

where G(u,v) and F(u,v) are the Fourier transforms of g(x,y) and f(x,y), and x denotes multiplication.

The coherent system 10 shown in FIG. 1 can recognize a pattern independently of its location in the x-y plane on the input transparency because both the hologram recording of the pattern to be recognized and the projected pattern from the transparency are Fourier transforms. Fourier transforms are "shift invariant", and are insensitive to translations with respect to the x and y axes. However, if the pattern included on the transparency is larger or smaller than a specified size, or if it is oriented in some arbitrary angular position different from the reference hologram (i.e., if it is rotated in the x-y plane), it will not be recognized by the coherent system 10. Hence, the coherent system 10 shown in FIG. 1 is displacement insensitive, but it is sensitive to the magnification and angular orientation of the pattern to be recognized.

Figure 2:
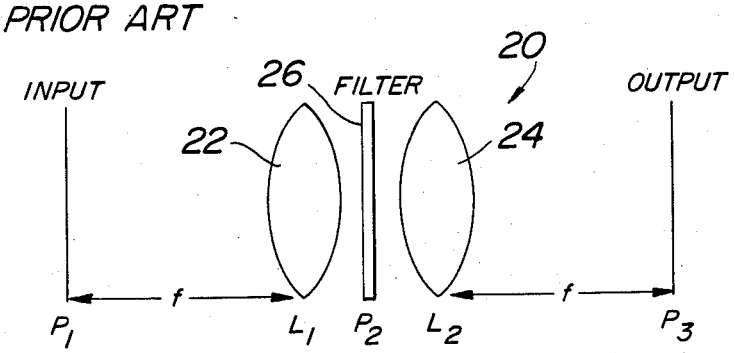
FIG. 2 PRIOR ART
FIG. 2 illustrates a simplified incoherent spatial filtering system known in the prior art.

The output intensity response to the coherent system 10 shown in FIG. 1 to spatially incoherent light is given by the equation $$|g(x,y)|^2=k|h(x,y)|^{2*}|f(x,y)|^2 \tag{3}$$

in which the convolution is now that of two intensity distributions and where k is a proportionality constant. The coherent system 10 can reduced in size when it is used with spatially incoherent light. Such a modified system 20 is shown in FIG. 2. The incoherent system 20 consists of a first lens 22 and a second lens 24. Between lens 22 and 24 is located the reference hologram or matched filter 26. Matched filter 26 is made in the same way as matched filter 18 of the coherent system 10, but with a transmittance function of the form $$h'(x,y)=[h(x,y)]^{\frac{1}{2}}e^{i\phi(x,y)} \tag{4}$$

where $\phi(x,y)$ is an arbitrary phase function. (The way in which the matched filters are made is discussed more fully below.)

If a matched filter having this transmittance function is used in an incoherent system 20 as shown in FIG. 2 and as described by the third equation given above, and if the input to the incoherent system has the form $[f(x,y)]^{\frac{1}{2}}$, the resulting equation describing the system becomes $$g(x,y)=kh'(x,y)*f(x,y) \tag{5}$$

By making the matched filter hologram 26 of random phase, the Fourier transform is distributed over the entire hologram, thereby improving the diffraction efficiency of the system. Since h'(x,y) can have any phase, moving the matched filter 26 along the x or y axis will not affect the correlation so long as filter 26 is not rotated in the x-y plane, which is a distinct advantage over coherent systems. Further, since the hologram is read out by plane waves, the z-axis location of the hologram is flexible. In other words, the relative spacing between first lens 22, second lens 24 and filter 26 is not critical, as it is in a coherent system.

Figure 3:
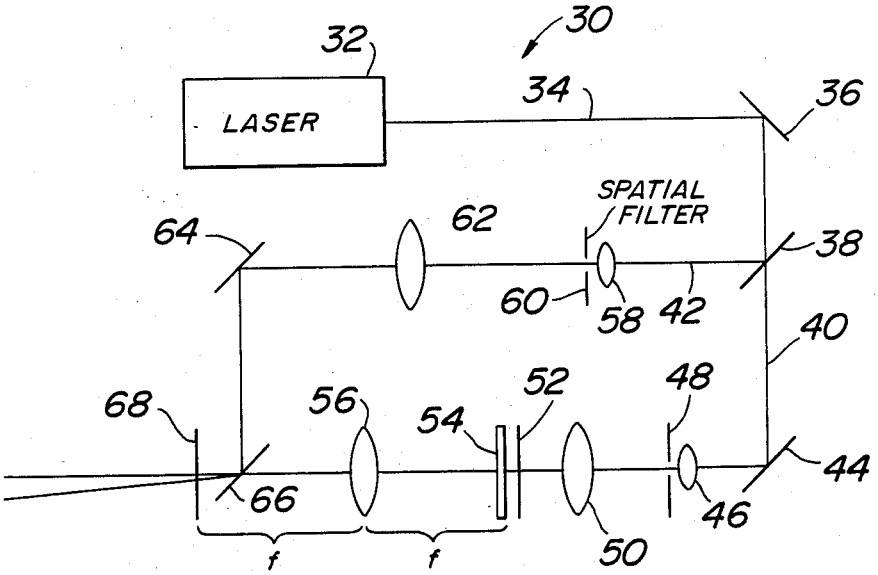
FIG. 3 is a block diagram of an apparatus for producing holographic matched spatial filters for use in incoherent or coherent spatial filtering systems.

FIG. 3 illustrates the way in which the matched filters 18 and 26 may be made. A laser 32 provides a coherent light beam 34 which is reflected by mirror 36 and directed to beam splitter 38. Beam splitter 38 divides the coherent light beam 34 into two beams, object beam 40 and reference beam 42, respectively. Object beam 40 is reflected from mirror 44 and through a focusing lens 46 and spatial filter 48. Spatial filter 48 is simply a pinhole filter. Lens 46 focuses object beam 40 to a very small diameter for passage through the pinhole of filter 48. The filter 48 serves to improve the coherence of object beam 40. After passing through spatial filter 48, object beam 40 is collimated by lens 50. If it is desired to make a matched filter 26 for use in an incoherent system, the collimated object beam 40 is passed through a stationary diffuser 52 to give object beam 40 a random phase distribution. After passing through stationary diffuser 52, the object beam 40 strikes object 54. If it is desired to make a matched filter 18 for use in a coherent system, stationary diffuser 52 is simply omitted. Object 54 is a phototransparency of the image or pattern to be recognized. The light passing through the object 54 is Fourier transformed by Fourier transforming lens 56, from where it passes to beam splitter 66.

At the same time, reference beam 42 passes through focusing lens 58 and spatial filter 60 to a collimating lens 62. Lens 58 and spatial filter 60 are identical to lens 46 and spatial filter 48, respectively. The collimated light from collimating lens 62 is reflected by mirror 64 and strikes beam splitter 66. The collimated light and the Fourier transform image of the object are combined in beam splitter 66 and are recorded on dichromate gelatin to form the matched filter hologram 68. It should be noted from FIG. 3 that the reference beam 42 and the object beam 40 intersect at the plane of the recording medium at a nonzero angle. A nonzero angle is necessary in order to separate the two beams when attempting to recover the recorded information. The manner in which the matched filter hologram 68 is recorded is well-understood in the art and need not be described further.

Figure 4:
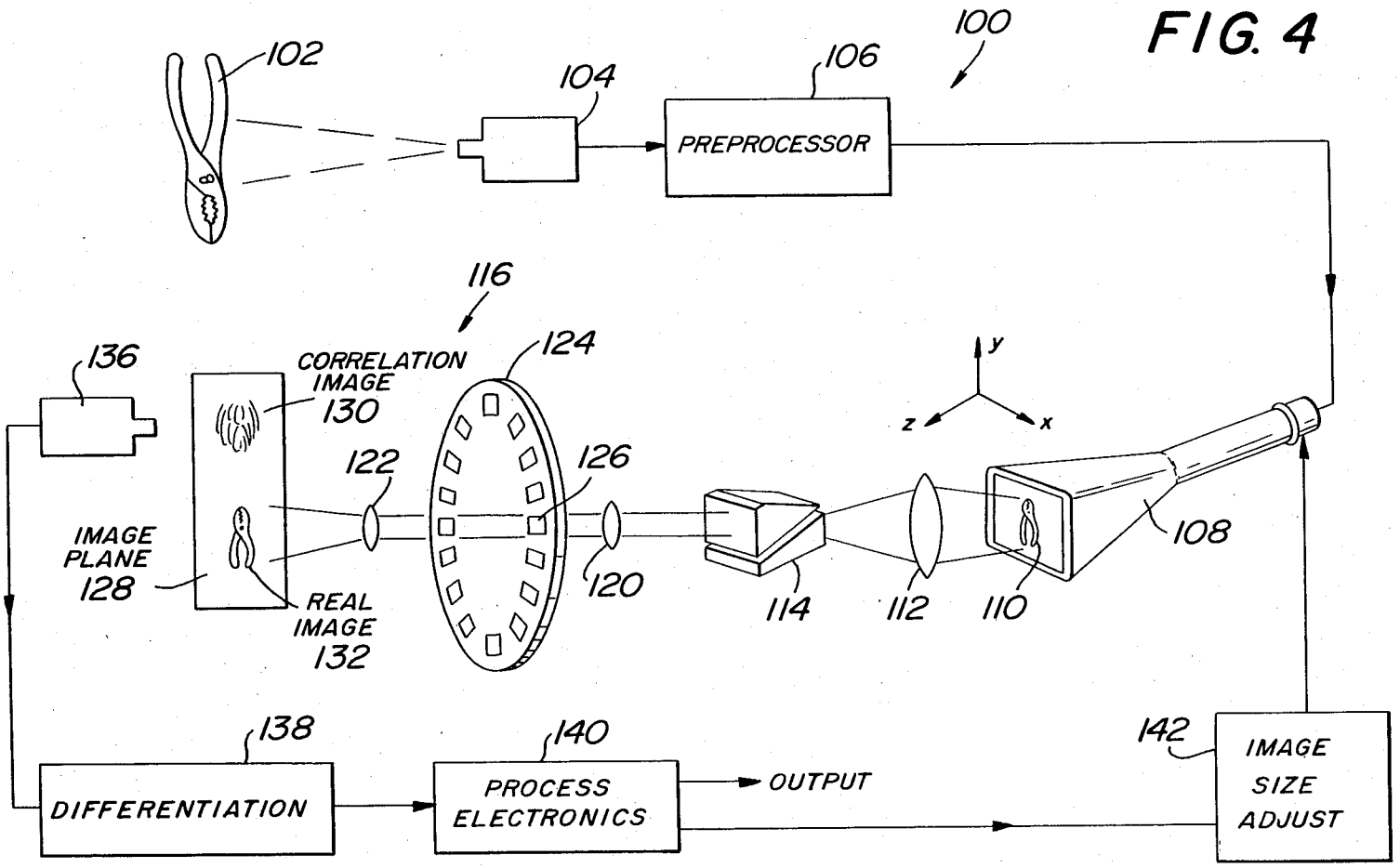
FIG. 4 is a block diagram of an incoherent optical correlator according to the present invention.

FIG. 4 is a block diagram of an incoherent optical correlator 100 in accordance with the present invention which utilizes the incoherent optical correlating system described above, but which adds electronic preprocessing of the image to be correlated in order to improve the performance of the optical system.

An object 102 to be recognized is imaged by a vidicon or TV camera 104. Camera 104 may be any suitable video camera. Object 102 has a unique two dimensional image function. That is, object 102 can be represented mathematically as a function of x and y. Camera 104 thus generates an electronic video signal which is representative of the image function of object 102. A preprocessor circuit 106 electronically performs one or more mathematical operations on the video signal of the image function to derive a second electronic signal. The preprocessor circuitry 106 is preferably located within the camera 104 between the video output of the camera and the point where the sync signal is added to the video. Preprocessor circuitry 106 may be any circuitry suitable to perform any desired mathematical operation on the video signal of the image. As one example, the preprocessor circuit 106 may be a circuit for performing edge enhancement of the video signal to sharpen the transition between the object and the background. A suitable edge enhancement circuit is described more fully below. As another example, preprocessor circuit 106 may include circuitry for applying a curvature function to the video signal to enable the system to recognize patterns or objects independent of their aspect angle.

The preprocessed video signal is then fed to CRT or TV monitor 108, which displays a planar, two dimensional image 110 of the object 102 as viewed by camera 104 and as preprocessed by preprocessor circuitry 106. CRT 108 is preferably of a narrow bandwidth, i.e., the image 110 is preferably substantially monochromatic. It should be noted that, because of preprocessing, image 110 will not be identical in appearance to object 102. Rather, image 110 will have a considerably different appearance from object 102, depending on the type of electronic preprocessing performed by preprocessor circuitry 106. In the system illustrated in FIG. 4, image 110 is an edge enhanced image of object 102. That is, image 110 will appear as a silhouette or outline of object 102 and will lack internal details of the object, but will present a sharp contrast between the outlines of the object and the background.

Image 110 is then imaged by lens 112 onto an image plane. Rotating prism 114 enables the apparatus 110 to perform incoherent optical correlation independent of the angular orientation of object 102 with respect to the z axis. Prism 114 may be of the type known in the art as a Pechan prism. By rapidly spinning prism 114, the image 110 can in effect be rotated about the z axis in the image plane.

The incoherent optical correlator section of apparatus 100 is indicated generally by numeral 116. Incoherent correlator section 116 comprises a first lens 120, which corresponds to first lens 22 as shown in FIG. 2, located a distance equal to its focal length from the plane of the image produced by focusing lens 112. Behind first lens 120 is a disc 124 which contains a plurality of matched filter holograms 126 for the various objects to be recognized by the apparatus 100. Second lens 122, which corresponds to second lens 24 as shown in FIG. 2, is located behind the disc 124. First lens 120 and second lens 122 have a common optical axis. The axis of disc 124 is arranged parallel to and spaced apart from the common optical axis to permit individual holograms 126 to be rotated into optical alignment with lenses 120 and 122. The matched filter holograms 126 may be indexed by any convenient indexing system for rotating disc 124 to present a particular hologram 126 to the incoherent correlator section 116 for the particular object 102 to be recognized.

The optical correlation function produced by incoherent optical correlator section 116 will appear at image plane 128 which is normal to the common optical axis. The optical correlation function will comprise a correlation image 130 and a real image 132 of two dimensional image 110. Real image 132 is ignored, and correlation image 130 is sensed by a second camera 136. Correlation image 130 is in the form of an intensity distribution and will appear to the eye as an intense bright spot surrounded by a disk of light of lesser intensity. The intensity and the location of the bright spot of correlation image 130 indicates first whether a recognition of object 102 has occurred and second where the object 102 is located in the x-y plane with respect to the optical axis of camera 104.

The output of camera 136 may then be analyzed as required by analyzer circuitry as shown in blocks 138 and 140 in FIG. 4. Feedback in the form of an image size adjuster 142 may be used to ensure that the proper size image 110 for processing by the incoherent optical correlator section 116 is displayed on monitor 108. Alternatively, a zoom lens may be used on camera 104 and controlled through an appropriate electronic/mechanical feedback loop to provide an image 110 of constant scale for optical correlator section 116.

Figure 5:
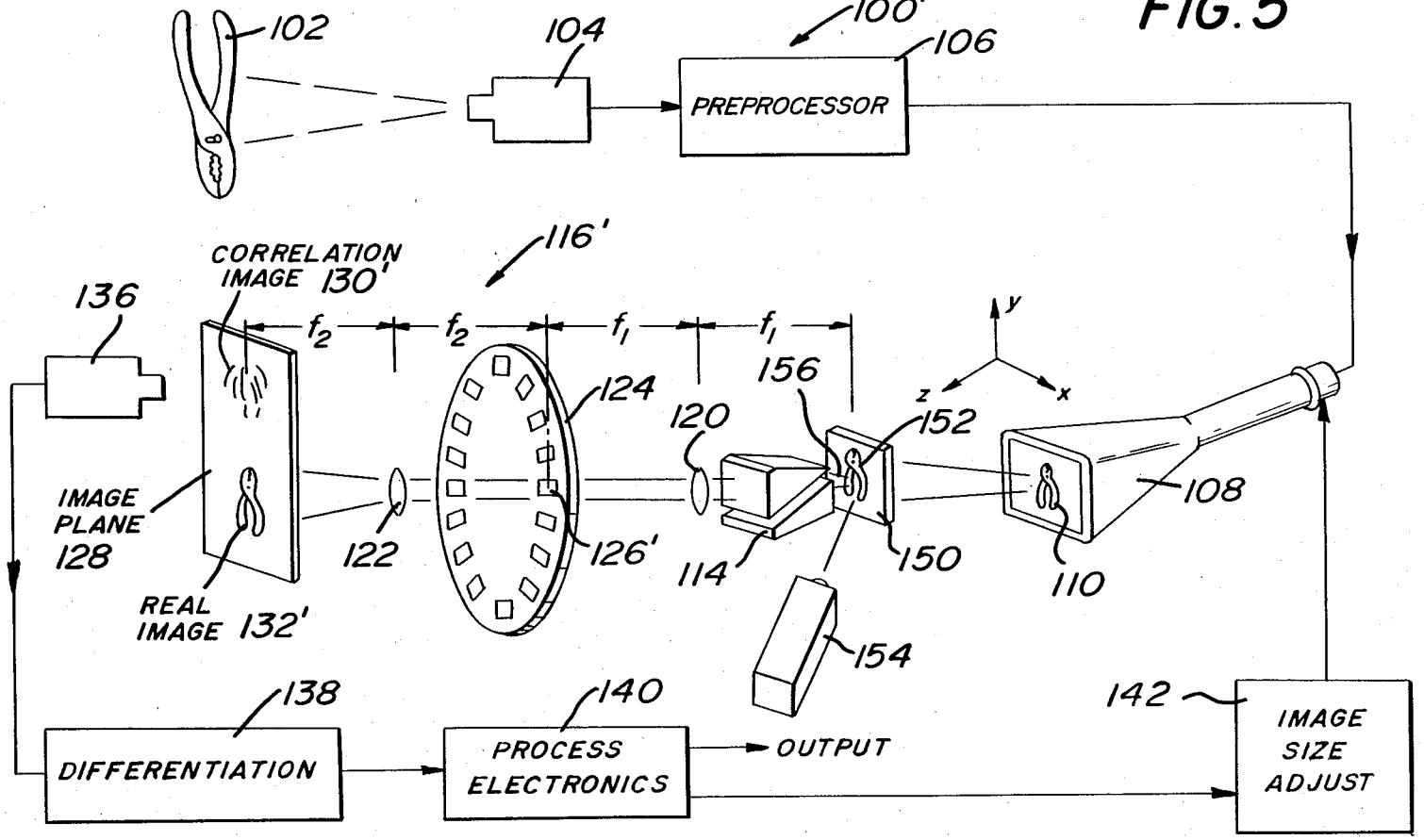
FIG. 5 is a block diagram of a coherent optical correlator according to the present invention.

An embodiment of the invention using coherent radiation is illustrated in FIG. 5 and is designated generally by the reference numeral 100'. Coherent system 100' is essentially identical to the incoherent system 100 illustrated in FIG. 4, except (1) the spacing of the elements of optical correlator section 116' is different, (2) hologram 126' does not have a random phase distribution, and (3) imaging lens 112 is replaced by a source of modulated coherent radiation in the form of laser 154 and spatial light modulator 150. Spatial light modulators are wellknown in the art and need not be described in detail. The function of the spatial light modulator 150 will be clear from the following discussion.

In operation, coherent system 100' is identical to incoherent system 100 up to the display of image 110 on CRT 108. Image 110 cannot be used directly as the input to coherent optical correlator section 116' because it is composed of spatially incoherent light (i.e., the light comprising image 110 is not a plane wave). It is therefore necessary to convert image 110 into an optical signal composed of coherent radiation. This is accomplished by spatial light modulator 150.

Spatial light modulator 150 presents at its output surface an image 152 of the image 110 displayed by CRT 108. The output surface of spatial light modulator 150 is located in the x-y plane at a distance from lens 120 equal to its focal length $f_1$. Thus, the plane of the output surface of spatial light modulator 150 corresponds to plane P1 of the coherent optical correlator illustrated in FIG. 1. A source of coherent radiation in the form of laser 154 is located off axis and illuminates image 152 such that the laser radiation 156 which is reflected from the output surface of spatial light modulator 150 is intensity modulated by image 152. The modulated radiation 156 reflected from the output surface of spatial light modulator 150 is temporally and spatially coherent and is intensity modulated to carry information regarding image 152, and is directed through rotating prism 114 to first lens 120 of optical correlator section 116'. Optical correlator section 116' is the same as that shown for the incoherent system 100 of FIG. 4, except that lenses 120 and 122 are each spaced apart from hologram 126' by a distance $f_1$ and $f_2$, and hologram 126' does not have a random phase distribution.

The optical correlation function produced by correlator section 116' will appear at image plane 128, which is normal to the optical axis and spaced a distance $f_2$ from lens 122. Image plane 128 corresponds to output plane P3 of FIG. 1. The optical correlation function will comprise a correlation image 130' and a real image 132' of image 152. Real image 132' is ignored, and correlation image 130' is sensed by camera 136. Correlation image 130' is in the form of an amplitude distribution, unlike correlation image 130 in incoherent system 100 which is in the form of an intensity distribution, but is processed in the same manner as image 130.

Figure 6:
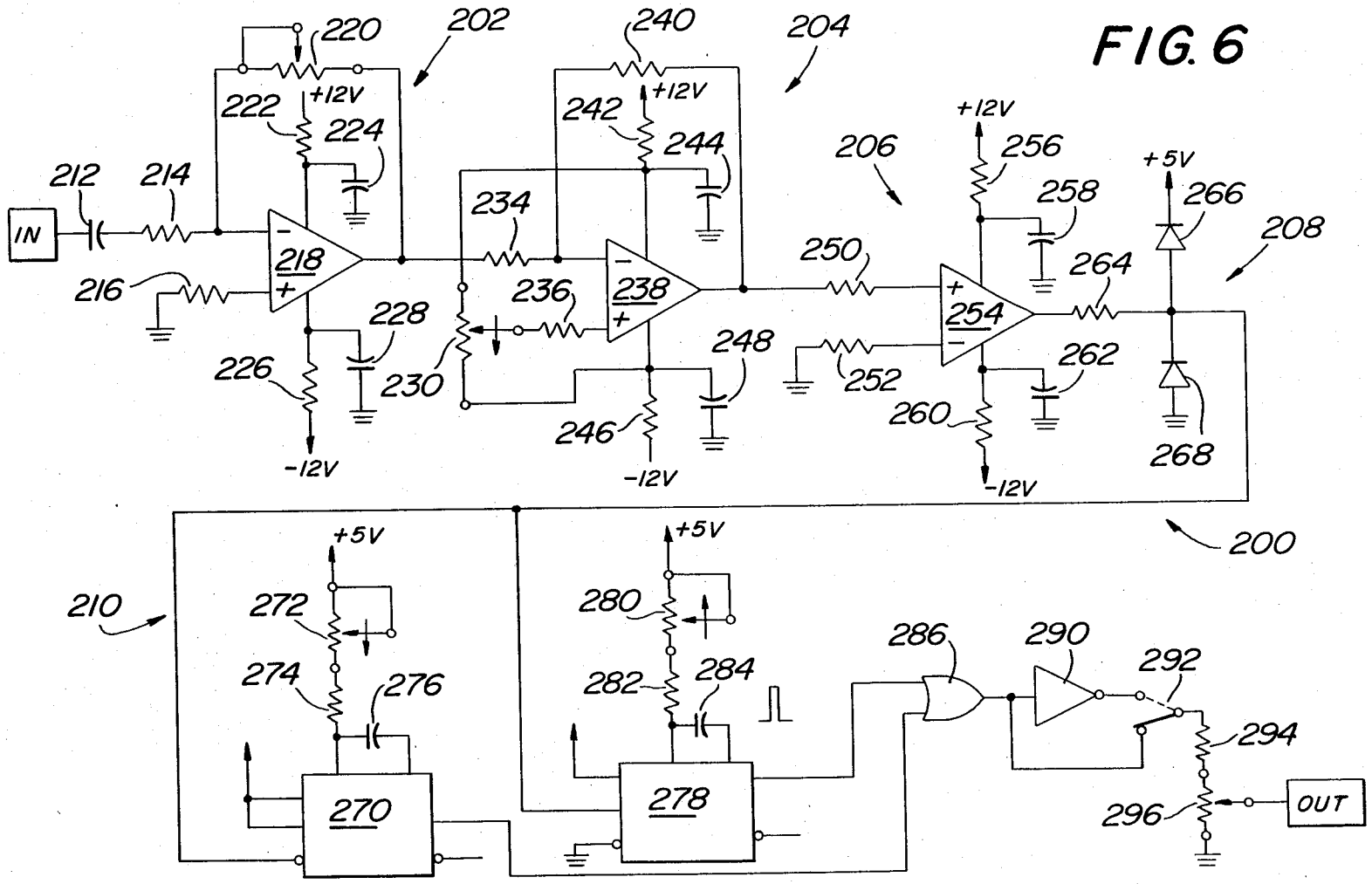
FIG. 6 is a schematic diagram of one type of electronic preprocessing circuit which can be used in the present invention.

FIG. 6 illustrates one form of edge enhancing circuit which may be used in the present invention. (Although edge enhancement is one form of electronic preprocessing which can be utilized with either system 100 or 100', the invention is not limited to the use of edge enhancement.) As noted above, edge enhancing circuit 200 is preferably located within camera 104 at a location just prior to the location where the sync signal is added to the video output signal. The edge enhancing circuit 200 consists of five major stages. Stage 202 comprises a conventional video amplifier to amplify the video output signal from camera 104. Following amplifier stage 202 is offset stage 204, which serves to introduce a dc offset into the amplified video, thereby shifting the video to prepare it for peak detector 206. Peak detector 206 is a conventional peak detecting circuit and detects when the offset amplified video exceeds a predetermined level. Each time the offset amplified video exceeds that predetermined level, amplifier 254 generates a pulse. The output of peak detector circuit 206 is limited by amplitude limiter stage 208 to 5 V dc so that the output pulses from peak detector stage 206 will be compatible with TTL logic.

The now-TTL compatible pulses are then sent to video pulse generator stage 210. Stage 210 comprises two TTL flip-flops 270, 278. Flip-flop 270 is connected to be triggered by the positive-going transitions of the pulses from peak detector 206, and flip-flop 278 is connected to be triggered by the negative-going transitions of the pulses from peak detector 206. The outputs of flip-flops 270 and 278 are combined in OR gate 286. Thus, the output of OR gate 286 is a series of pulses, with one pulse for each transition of the output of peak detector stage 206. The output of OR gate 286 is thus representative of the transitions between the background and the object being viewed by camera 104. The pulses from OR gate 286 may be inverted by inverter 290 and then sent to the monitor 108, or may be sent directly to monitor 108. Switch 292 permits either the non-inverted or inverted pulses to be sent to monitor 108. Depending on whether the noninverted or inverted pulses are sent to monitor 108, image 110 will appear as either a black silhouette on a white background or a white silhouette on a black background. All internal detail of the object being viewed by camera 104 will be lost, but the transitions between the background and the object will be enhanced. The edge enhanced image will enable the optical correlator sections 116 and 116' to provide a more intense correlation spot and will thereby improve the performance of both system 100 and 100'.

Figure 7:
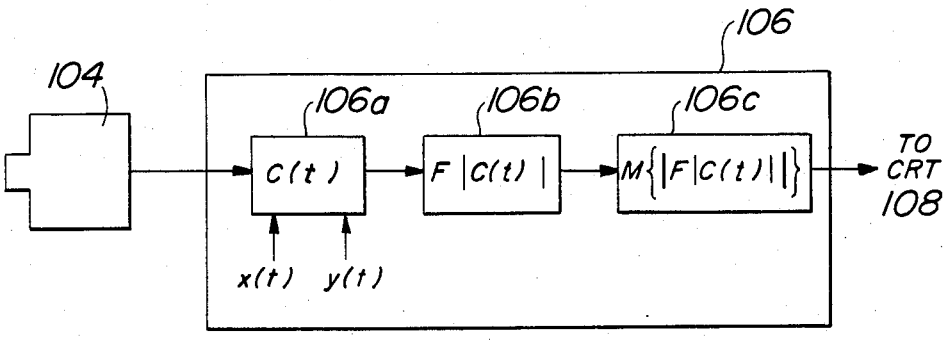
FIG. 7 is a block diagram of a second type of electronic preprocessing circuit which can be used in the present invention.

System 100 or 100' may also be used to recognize objects independently of their aspect angle (that is, their rotation about an axis other than the z-axis) by applying an electronic curvature function of the form $$c(t)=d/dt \arctan y(t)/x(t) \qquad (6)$$

to the video output of TV camera 104. This technique is depicted in block diagram form in FIG. 7. In equation (6), y(t) and x(t) describe the outline of the object and c(t) represents a one dimensional representation of a two dimensional object. A Fourier transform of the curvature function is then performed electronically, and a Mellin transform of the magnitude of the Fourier transform is performed electronically. The resulting signal is a new function which is both scale and rotation invariant (properties of the Mellin and Fourier transforms) as well as shift invariant. A comparison between this new function, which can be displayed on monitor 108, and all possible functions representing a given object from all possible aspect angles, which can be recorded on holographic matched filters 126 and 126' can be performed.

Figure 8:
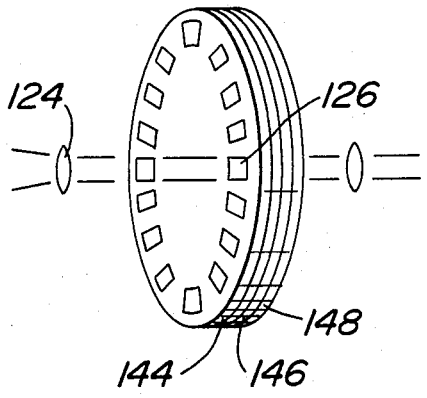
FIG. 8 illustrates an alternate embodiment of the matched filter storage system of the present invention.

FIG. 8 illustrates another embodiment of a portion of system 100 or 100' which enables a large number of hologram filters to be rapidly indexed. A first disc 144, a second disc 146 and a third disc 148, each bearing a plurality of matched filter holograms, are mounted for independent rotation about a common axis parallel to the optical axis of correlator section 116. Each of discs 144, 146 and 148 has at least one location where no hologram is located. By aligning discs 144, 146 and 148 properly, a selected hologram on any of the three discs may be located between first and second lenses 120 and 124. This permits a large number of holograms to be accessed and processed. In addition, it is possible to discriminate between objects by performing the optical correlation using holograms sequentially. Thus, the apparatus 100 or 100' can in effect choose between objects.

In addition to performing correlation with images of real objects, the present invention can be used to correlate any two-dimensional function which can be depicted in graphic form. For example, monitor 108 may be used to display a voiceprint for correlation with a reference voiceprint recorded in holographic form on a matched filter as a means of performing voice recognition. Likewise, fingerprint patterns may be displayed on monitor 108 and correlated with reference fingerprints. These are just two, non-limiting examples of the uses to which the present invention can be put.

It has been found that the incoherent system 100 of the present invention compares favorably to coherent optical correlation without the drawbacks of a coherent system. In addition, the use of electronic preprocessing enhances the correlation operation over present systems using either coherent or incoherent radiation.

The present invention may be embodied in other specific forms without departing from the spirit or essential attributes thereof and, accordingly, reference should be made to the appended claims, rather than to the foregoing specification, as indicating the scope of the invention.

We claim:

1. Apparatus for incoherent optical correlation of a two-dimensional function, comprising:

(a) means for generating a first electronic signal representative of said function;

(b) means for electronically performing at least one mathematical operation on said first electronic signal to derive a second electronic signal;

(c) means for electrically converting said second electronic signal into a two-dimensional spatially and temporally incoherent visual image, said two-dimensional visual image having an associated mathematical image function;

(d) imaging means for producing a secondary image of said two-dimensional visual image in an image plane, said second image likewise being spatially and temporally incoherent;

(e) means for generating an optical correlation function having (i) first and second lens means arranged with their respective optical axes substantially in alignment, said first lens means being spaced apart from said imaging means such that said image plane and the focal plane of said first lens means coincide, the object of said first lens means being said two-dimensional spatially and temporally incoherent image, and (ii) match optical filter means located between said first and second lens means, said filter means having a random phase distribution and a predetermined transfer function whose amplitude is the square root of the amplitude of said image function;

(f) optical detecting means located on the side of said second lens means opposite said filter means and at the image plane of said second lens means for detecting the optical correlation function generated by said first and second lens means and said filter means and generating a third electronic signal representative of said optical correlation function; and (g) electronic analyzer means for analyzing said third electronic signal to determine the amplitude and position of the peak of the optical correlation function.

2. Apparatus in accordance with claim 1, further comprising means for causing said two-dimensional image to rotate about an axis which is substantially parallel to the optical axes of said first and second lens means.

3. Apparatus according to claim 1, further comprising feedback means from said optical detecting means to said display means for controlling the size of said two dimensional image.

4. Apparatus according to claim 1, wherein said means for generating a first electronic signal representative of said two-dimensional function comprises a video camera.

5. Apparatus according to claim 4, wherein said means for electronically performing at least one mathematical operation on said first electronic signal comprises an edge-enhancement circuit.

6. Apparatus according to claim 1, wherein said means for electronically performing at least one mathematical operation on said first electronic signal comprises means for applying at least a curvature function to said first electronic signal.

7. Apparatus according to claim 6, wherein said means for applying at least a curvature function to said first electronic signal further includes means for applying a Fourier transform to said electronic signal after said curvature function has been applied.

8. Apparatus according to claim 7, wherein said means for applying at least a curvature function to said first electronic signal further includes means for applying a Mellin transform to the Fourier transformed signal.

9. Apparatus according to claim 1, wherein said display means is a norrow-band cathode ray tude which produces a substantially monochromatic image.

10. Apparatus according to claim 9, wherein said cathode ray tube is a television monitor.

11. Apparatus according to claim 1 wherein said optical detecting means comprises a video camera.

12. Method for performing incoherent optical correlation of a two-dimensional function, comprising the steps of:

(a) generating a first electronic signal representation of said function;

(b) electronically performing at least one mathematical operation on said first electronic signal to derive a second electronic signal;

(c) electronically converting said second electronic signal into a spatially and temporally incoherent optical signal having an associated mathematical image function;

(d) generating an optical correlation function by convolving said mathematical image function with a filter transfer function having a random phase distribution and an amplitude which is the square root of the amplitude of said image function;

(e) electronically detecting said optical correlation function and generating a third electronic signal representative of said optical correlation function; and (f) electronically analyzing said third electronic signal to determine the amplitude and position of the peak of the optical correlation function.

13. Method according to claim 12, wherein the step of electronically performing at least one mathematical operation on said first electronic signal comprises performing edge enhancement of said signal.

14. Method according to claim 12, wherein the step of electronically performing at least one mathematical operation on said first electronic signal comprises applying a curvature function to said signal.

15. Method according to claim 14, further comprising the step of performing a Fourier transform of said signal after said curvature signal has been applied.

16. Method according to claim 15, further comprising the step of performing a Mellin transform on said Fourier transformed signal.

* * * * *